US006142028A

United States Patent [19]

Soh

[11] Patent Number: 6,142,028

[45] Date of Patent: Nov. 7, 2000

[54] STARTER MOTOR WITH SPEED REDUCTION MECHANISM

[75] Inventor: Masahiro Soh, Anjo, Japan

[73] Assignee: Denso Corporation, Kariya, Japan

[21] Appl. No.: 09/063,487

[22] Filed: Apr. 21, 1998

[30] Foreign Application Priority Data

Apr. 23, 1997 [JP] Japan ..... 9-105535

[51] Int. Cl.[7] ..... F02N 11/10

[52] U.S. Cl. ..... 74/7 C; 74/7 A; 74/7 E; 192/42

[58] Field of Search ..... 74/6, 7 C, 7 E, 74/7 R; 192/42

[56] References Cited

U.S. PATENT DOCUMENTS 4,974,463 12/1990 Luiki ..... 74/7 A 4,987,786 1/1991 Morishita et al. ..... 74/7 C 5,625,242 4/1997 Shiga et al. .

FOREIGN PATENT DOCUMENTS 57-55970 12/1982 Japan .

*Primary Examiner*—David M. Fenstermacher

*Attorney, Agent, or Firm*—Pillsbury Madison & Sutro LLP

[57] ABSTRACT

A starter is composed of an output shaft, a pinion having an outer gear slidably disposed on the output shaft, a planetary gear-type speed reduction mechanism, a one-way clutch having clutch outer linked with the planetary gears, a clutch inner linked with the output shaft and a plurality of rollers disposed between the clutch outer and clutch inner, and an alignment member, disposed around the one-way clutch. The alignment member restricts deviation of axis of the clutch outer from the axis of the output shaft.

5 Claims, 3 Drawing Sheets

STARTER MOTOR WITH SPEED REDUCTION MECHANISM

CROSS REFERENCE TO RELATED APPLICATION

The present application is based on and claims priority from Japanese Patent Application Hei 9-105535, filed on Apr. 23, 1997, the contents of which are incorporated herein by reference.

BACKGROUND OF THE INVENTION

1. Field of the Invention

The present invention relates to a starter for starting an engine.

2. Description of the Related Art

JP-Y2-57-55970 discloses a starter which has a planetary-gear-type one-way clutch and a one-way clutch having a clutch inner member connected to an output shaft and a clutch outer member connected to the planetary gears. The one-way clutch also includes a plurality of rollers disposed between the clutch outer member and the clutch inner member. In this speed reduction mechanism, the clutch outer member and the output shaft are only connected by the rollers. In order to prevent the clutch outer member from coming out of alignment with the output shaft, a bearing is inserted between the clutch outer member and the output shaft. Such alignment problems can occur because of engine torque fluctuation, which can have a detrimental effect on the transmission torque. In order to prevent the bearing from deviating from the center axis of the output shaft when large outside pressure is applied to the bearing, the bearing must have a considerable axial length because increase in the shaft diameter is not possible because of the structure.

SUMMARY OF THE INVENTION

Therefore, a main object of the present invention is to provide an improved starter which has an alignment member that prevents the clutch from deviating the center axis of the output shaft without increasing the axial length of the bearing.

According to a main feature of the present invention, a starter includes an output shaft, a pinion having an outer bear slidably disposed around the output shaft, a speed reduction mechanism having a sun gear, a planetary gear, an internal gear and a supporting pin for supporting the planetary gear. The starter also includes a one-way clutch having a clutch outer member linked with the supporting pin, a clutch inner member linked with the output shaft and a plurality of rollers disposed between the clutch outer and clutch inner members and an alignment member disposed around the one-way clutch. The alignment member restricts the deviation of the clutch inner member and clutch outer member axes from the output shaft axis.

In the above starter, the alignment member may include a cylindrical member, disposed opposite the clutch outer member, and spaced to restrict radial displacement of the clutch outer member. The above starter may include a slide member, which slides when a certain torque is applied thereto, and the slide member may be integrated with the alignment member. The alignment member may also be integrated with the internal gear. The alignment member may include a bearing for supporting the outer periphery of the clutch outer member.

BRIEF DESCRIPTION OF THE DRAWINGS

Other objects, features and characteristics of the present invention, as well as the functions of related parts of the present invention, will become clear from a study of the following detailed description, the appended claims, and the drawings. In the drawings:

DETAILED DESCRIPTION OF THE PREFERRED EMBODIMENT

First Embodiment

Figure 1:
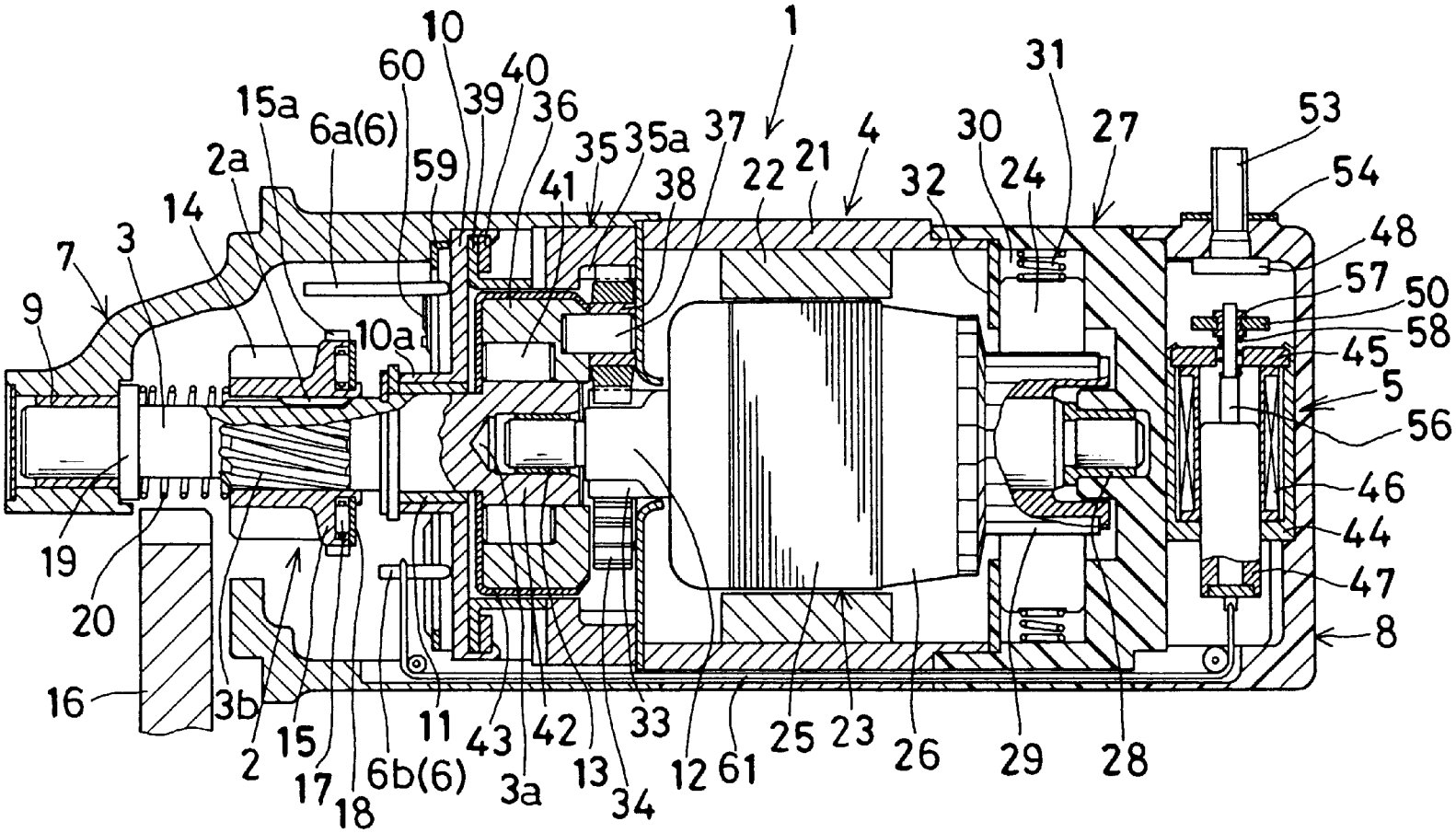
FIG. 1 is a general cross-sectional view illustrating a starter according to a first embodiment of the present invention.

A starter with a speed reduction mechanism according to a first embodiment of the present invention is described with reference to FIGS. 1–4.

Starter 1 is composed of an output shaft 3 which has a slidable pinion 2 disposed thereon, a drive motor 4 which has a motor shaft 12, a planetary-gear-type speed reduction mechanism (described below), a one-way clutch (described below), an electromagnetic clutch 5 for supplying power to the drive motor 4, a rotation stopper 6 for pinion 2, a front case 7, and a rear case 8.

Front case 7 has a front support portion for a bearing 9 and a cylindrical portion in which a center case 10 is disposed. Center case 10 has an inner cylindrical portion 10*a* for holding bearing 11. Output shaft 3 extends axially from the front of the drive motor 4 and is rotatably supported and axially fixed by bearings 9, 11. Output shaft 3 has a cylindrical concave 34*a*, coaxially formed at the rear end thereof, to fix bearing 13 for motor shaft 12. The output shaft 3, also has a helical spline 3*b* formed on the outer periphery thereof and in front (left in FIG. 1) of center case 10.

Figure 2:
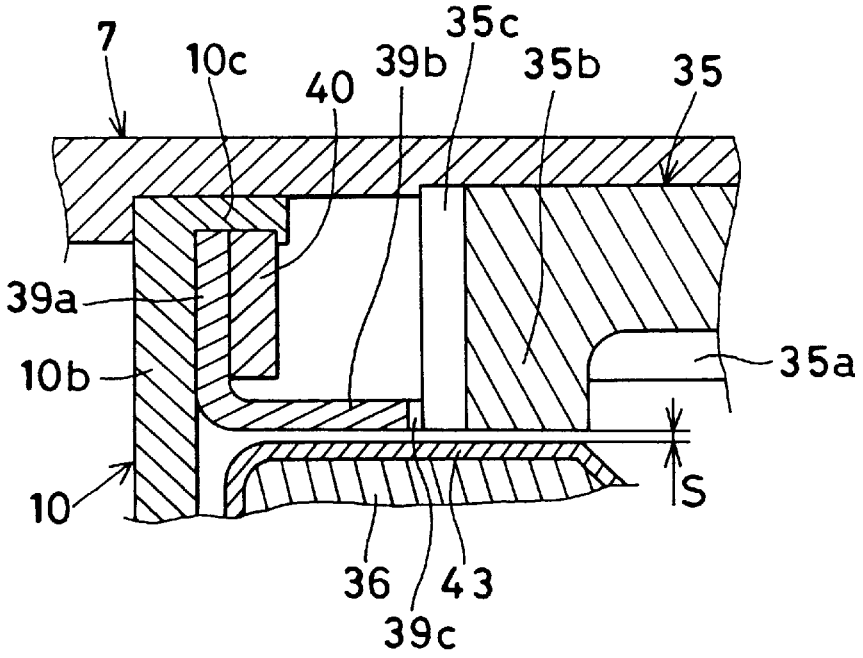
FIG. 2 is a fragmentary cross-sectional view of a main portion of the starter according to the first embodiment.

As shown in FIG. 2, center case 10 is composed of the above inner cylindrical portion 10*a* and a disk portion 10*b*, disposed perpendicular to output shaft 3 and outer cylindrical portion 10*c*, which extends rearward in order to be pressure-fitted into front case 7. Thus, center case 10 is axially and circumferentially fixed to front case 7.

Pinion 2 has a pinion gear 14, a flange 15 which has a larger outer diameter than pinion gear 14, and an internal helical spline 2*a* which engages helical spline 3*b* of output shaft 3.

Pinion gear 14 is capable of engaging ring gear 16 of the engine to transmit the driving force of drive motor 4. Flange 15 has teeth 15*a*, formed on the outer periphery thereof, and a back surface to which washer 18 is rotatably secured via rollers 17. Return spring 20 is disposed between collar 19 and the front surface of pinion 2, in order to bias pinion 2 rearward (right in FIG. 1).

Drive motor 4 is composed of a cylindrical yoke 21, stationary magnetic poles 22, an armature 23 disposed inside magnetic poles 22 and pressure-fitted to motor shaft 12., brushes 24 for supplying electric power to armature 23, a brush holder 27, and a commutator 29 disposed at the rear of armature 23. Armature 23 has an armature core 25 fixed to the outer periphery of motor shaft 12 and an armature winding 26, wound thereon. One of the ends of motor shaft 12 is supported by bearing 13, disposed in concave 3*a* of output shaft 3, and the other end of motor shaft 12 is supported by bearing 28 which is fixed to brush holder 27. Commutator 29 is coupled to the armature coil both mechanically and electrically. Brushes 24 are held in brush compartments 30 formed in portions of brush holder 27, around the commutator 29, respectively, and covered by a plate 32, disposed between the rear end of yoke 21 and brush holder 27. Brushes 24 are radially slidable in compartment 30. Brush holder 27 has a frame portion of the outer cover of starter 1. In other words, the outer cover is composed of front case 7, yoke 21, brush holder 27, and rear case 8.

Figure 3A:
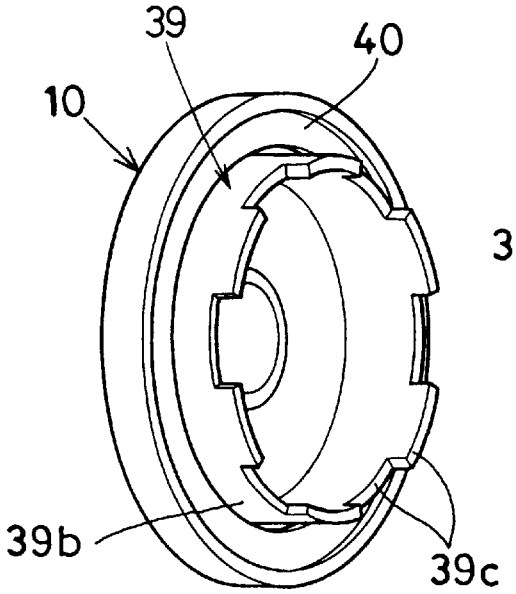
FIG. 3A is a perspective view illustrating an assembled unit of a slide member and a washer of the starter according to the first embodiment.
Figure 3B:
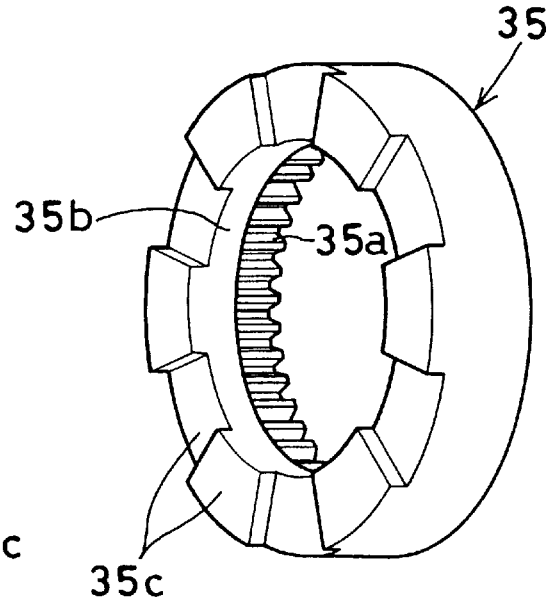
FIG. 3B is a perspective view illustrating an internal gear of the starter according to the first embodiment.

Sun gear 33 of the speed reduction mechanisms is formed on the outer periphery of motor shaft 12 of drive motor 4. Each of the planetary gears 34 is disposed between sun gear 33 and an internal gear 35*a*, in engagement therewith, and is rotatably supported by a bearing 38 disposed around a pin 37, which is fixed to clutch outer 36 member. When sun gear 33 rotates, planetary gear 34 rotates on its axis and moves around sun gear 33. Internal gear member 35 has internal gear 35*a* and a ring portion 35*b*. Ring portion 35*b* has teeth 35*c* formed on the front surface thereof. Internal bear member 35 is disposed in front case 7 in order to be slidable on disk portion 10*b* of center case 10 and is connected to a slide member 39. Slide member 39 is made of phosphor bronze and has a slide surface 39*a*, which abuts to disk portion 10*b* of center case 10, and a cylindrical portion 39*b*, which extends rearward from the inner periphery of slide surface 39*a*, as shown in FIG. 2. Washer 40 biases slide surface 39*a* against disk portion 10*b* at a suitable pressure. The outer periphery of washer 40 is held by caulking the edge of the outer cylindrical portion 10*c* of center case 10. Lubrication grease is applied between slide member 39 and disk portion 10*b* and between slide member 39 and washer 40. Thus, rotation of slide member 39 is stopped by center case 10 and washer 40, until a certain torque is applied to slide member 39. As shown in FIGS. 3A, 3B, slide member 39 has teeth 39*c* formed on the edge of cylindrical portion 39*b*, which engages with teeth 35*c* of internal gear member 35. Accordingly, the rotation of internal gear member 35 is stopped by slide member 39 until a certain torque of a predetermined force is applied to slide member 39. If a torque or shock, larger than the predetermined torque, is applied to slide member 39, internal gear member 35 rotates together with slide member 39. The inside diameter of cylindrical portion 39*b* of slide member 39 is the same as the inside diameter of ring portion 35*b* of internal gear member 35.

The one-way clutch is composed of a clutch outer member 36, which is rotated by the speed reduction mechanism, a clutch inner 42 member, disposed at the rear end of output shaft 3 to be linked therewith, a plurality of rollers 41 disposed in a cam chamber between clutch outer member 36 and clutch inner member 42, and a clutch cover 43 disposed around clutch outer member 36. Clutch outer member 36 is also disposed around the rear end of output shaft 3. Clutch outer member 36 has a plurality of pins 37, pressure-fitted thereto, to rotatably support planetary gears 34. As stated above, planetary gears 34 move around sun gear 33. The cam chamber has a plurality of wedge-shaped spaces, each of which accommodates one of the rollers 41, which are biased by a spring to be wedged. When clutch outer member 36 rotates, it pushes rollers 41 so that the clutch outer member 36 and the clutch inner member 42 can be linked with each other. On the other hand, when the rotation speed of clutch inner member 42 is faster than clutch outer member 36, the rollers 41 move to the opposite side in order to terminate the linkage between the clutch inner member 42 and clutch outer member 36.

When the center axis of clutch outer member 36 aligns with the axis of output shaft 3, a gap S (about 1 mm) is formed between the outer periphery of clutch cover 43 and the inner periphery of cylindrical portion 39*b* of slide member 39. This gap is also formed between the outer periphery of clutch cover 43 and the inner periphery of the ring portion 35*b* of internal gear member 35, as shown in FIG. 2.

Electromagnetic switch 5 is disposed at the rear of starter 1 and at the back of brush holder 27 and is housed in a bowl-shaped rear case 8.

Electromagnetic switch 5 is composed of a cylindrical frame 44 having a bottom hole at the bottom thereof, a disk plate 45 caulked to the open edge of frame 44, an attraction coil 46 disposed in the cylindrical frame 44, and a plunger 47 disposed inside the attraction coil 46 so as to move back and forth through the bottom hole of the frame 44. Frame 44, disk plate 45, and plunger 47 are made of magnetic material, such as iron, and form magnetic paths for electromagnetic switch 5. Plunger 47 is disposed opposite to disk plate 45, via an air gap inside attraction coil 46, and is driven (e.g., upward in FIG. 1) toward disk plate 45 when attraction coil 46 is energized and the magnetic flux passes through the magnetic paths.

A motor contact unit is composed of a battery-side stationary contact 48, a motor-side stationary contact 49, and a movable contact 50. Battery-side stationary contact 48 is integrated with a battery terminal 53, which is connected to battery 52 through cable 51 and is disposed inside the rear case 8 and opposite the movable contact 50.

Battery terminal 53 has a male screw pole, protruding from rear case 8, and a washer 54, for fixing the screw pole to rear case 8. Motor-side stationary contact 49 is connected to the plus-side brush 24 through lead wire 55 and is fixed to rear case 8, in parallel fashion, with battery-side stationary contact 48 opposite movable contact 50. Movable contact 50 is fixed, via insulating member 57 and contact spring 58, to road 56 which is integrated with a plunger 47.

Movable contact 50 moves together with plunger 47 and connects or disconnects both stationary contacts 48, 49 in order to supply or cut power to the motor 23. Contact spring 57 applies a suitable contact pressure on stationary contacts 48, 49 via movable contact 50. Rod 56 extends upward from the upper center of plunger 47 through a center hole of disk plate 45. Contact spring 58 is wound around rod 56 and is fixed to insulating member 57, at the upper end thereof, and retained to a step portion formed on the outer periphery of rod 56 at the other end.

Rotation stopper 6 is made of spring material having a coiled portion and straight portions 6*a*, 6*b* which extend forward in the axial direction. The coiled portion is disposed in a space formed between disk portion 10*b* of center case 10 and ring plate 59 fixed to the front surface of disk portion 10*b*. Rotation stopper 6 is biased upward in FIG. 1 by spring 60 which is fixed to ring plate 59, so that the entire rotation stopper 6 can move up and down. Each of straight portions 6*a*, 6*b* of rotation stopper 6 extends forward through a hole of ring plate 59. As shown in FIG. 1, straight portion 6*a* is positioned above output shaft 3, on a circumference beyond flange 15, and straight portion 6*b* is positioned behind pinion 2 and below output shaft 3. Straight portion 6*a* is long enough to engage teeth 15*a* when rotation stopper is pulled down, even if pinion 14 moves forward to be in contact with ring gear 16. Wire 61 is linked to one end of straight portion 6*b* to transmit the attraction force of electromagnetic switch 5 to rotation stopper 6. Wire 61 is linked with the bottom plunger 47 at the other end thereof. When the attraction force of electromagnetic switch 5 is transmitted through wire 61, the rotation stopper 6 is pulled down against spring 60. On the other hand it is returned by spring 60 to the original position, when the attraction force is not transmitted.

The operation of the starter 1 according to the first embodiment is described hereafter.

Figure 4:
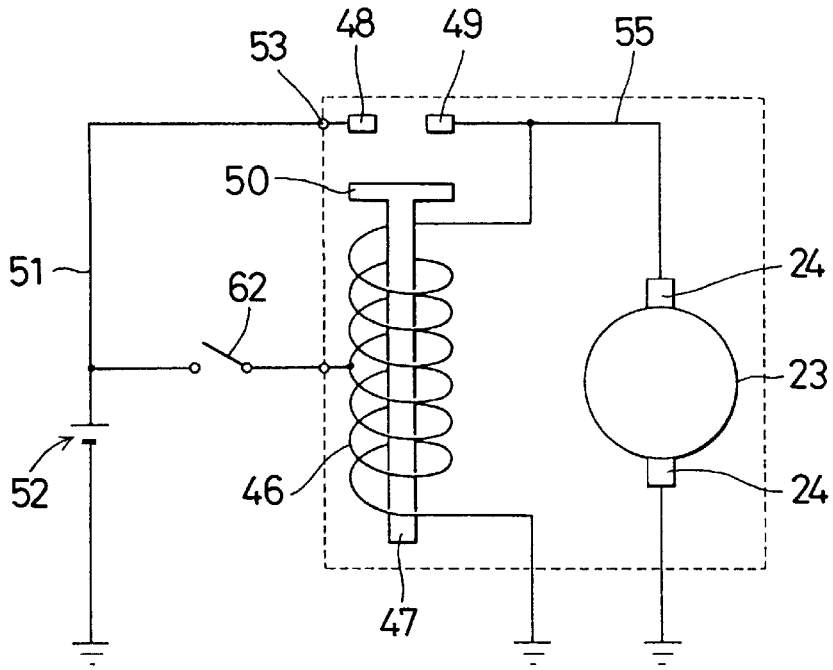
FIG. 4 is a block diagram of the starter according to the first embodiment.

When key switch 62, as shown in FIG. 4, is turned on, electric current is supplied to attraction coil 46, thereby attracting plunger 47 upward as in FIG. 1. When plunger 47 moves upward, straight portion 6*b* is pulled down via wire 61, so that the entire rotation stopper 6 moves downward while compressing spring 60. Thus, straight portion 6*a* engages the teeth 15*a* of pinion flange 15, so as to stop the rotation of pinion 2.

Thereafter, when movable contact 50, which is integrated with plunger 47, comes into contact with both stationary contacts 48, 48 m electric current is supplied to armature 23 in order to rotate the same. The rotation speed of armature 23 is reduced by the speed reduction mechanism and transmitted to output shaft 3 through the one-way clutch. Since the rotation of pinion 2 is restricted by rotation stopper 6, the rotation of the output shaft 3 causes pinion 2 to move forward via helical splines 3*b*, 2*a* which are formed on the outer periphery of output shaft 3 and the inner periphery of pinion 2, Accordingly, pinion gear 14 engages ring gear 16 so that the rotation of drive motor 4 can be transmitted, via pinion gear 14 and ring gear 16, in order to start the engine. When pinion gear 14 and ring gear 16 engage each other, straight portion 6*a* of rotation stopper 6 disengages from teeth 15*a* and settles at the rear of washer 18, thereby restricting retraction of pinion 2.

Even when the engine starts and pinion gear 14 is rotated by ring gear 16, resulting in the pinion gear 14 rotation speed becoming faster than the clutch outer member 36 rotation speed, the rotation of output shaft 3 is not transmitted to the clutch outer member 36 because of the one-way clutch. As such, the armature 23 rotates at a constant speed. If a shock is applied to starter 1 when pinion gear 14 engages ring gear 16 or when the engine load changes abruptly, slide member 39 and internal gear member 35 rotate idly to relieve the shock that would otherwise be transmitted to the motor 4. If clutch outer member 36 deviates from alignment with output shaft 3, the outer edge of clutch cover 43 abuts the inner periphery of cylindrical portion 39*b* of slide member 39 as well as the inner periphery of ring portion 35*b* of internal gear member 35. Accordingly, further deviation of clutch outer member 36 can be prevented. Thus, the pressure applied to the inner periphery of cylindrical portion 39*b* or of ring portion 35*b* can be reduced.

When key switch 72 is opened, after the engine has been started, the current supply to attraction coil 46 is stopped. Consequently, rotation stopper 6 is returned to the original position by spring 60, so that straight portion 6*a* of rotation stopper 6 leaves washer 18 of pinion 2, thereby freeing pinion 2. As a result, pinion 2 slides backward along output shaft 3, and pinion gear 14 disengages from ring gear 16. Consequently, plunger 47 is pulled down via wire 61, and movable contact 50 leaves both stationary contacts, 48,49 to terminate the current supply to armature 23. Thus, the rotation of armature 23 stops.

Second Embodiment

Figure 5:
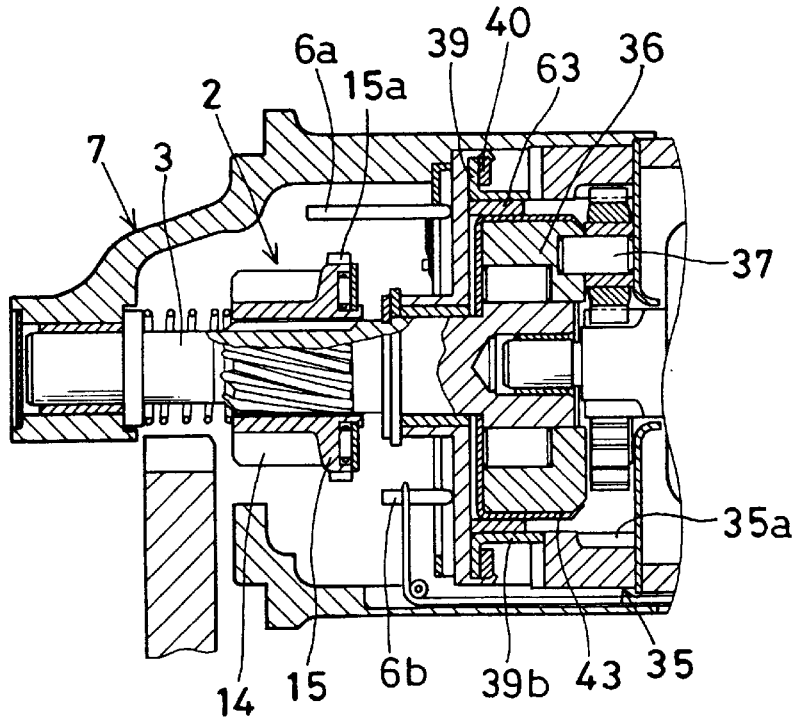
FIG. 5 is a fragmentary cross-sectional view illustrating a main portion of a starter according to a second embodiment of the present invention.

A starter according to a second embodiment of the present invention is described briefly with reference to FIG. 5. Bearing 63 is disposed between cylindrical portion 39*b* of slide member 39 and clutch cover 43 to support the outer periphery of clutch cover 43. Accordingly, deviation of the clutch outer member 36 is effectively prevented.

In the foregoing description of the present invention, the invention has been disclosed with reference to specific embodiments thereof. It will, however, be evident that various modifications and changes may be made to the specific embodiments of the present invention without departing from the broader spirit and scope of the invention, as set forth in the appended claims. Accordingly, the description of the present invention in this document is to be regarded in an illustrative, rather than restrictive, sense.

What is claimed is:

1. A starter comprising:

a case member;

a drive motor disposed in said case member;

an output shaft;

a pinion having an outer gear and being slidably disposed on said output shaft;

speed reduction mechanism, disposed in said case member, including a sun gear linked with said drive motor, a planetary gear, an internal gear, and a supporting pin for supporting said planetary gear;

a one-way clutch having a clutch outer member linked with said supporting pin, a clutch inner member linked with said output shaft, and a plurality of rollers disposed between said clutch outer member and clutch inner member; and an alignment member, disposed in said case member around said one-way clutch, to provide a prescribed gap between an inner periphery of said alignment member and an outer periphery of said clutch outer member in order to restrict a radial displacement of said one-way clutch from the axis of said output shaft.

2. A starter as claimed in claim 1, wherein said alignment member comprises a cylindrical member disposed opposite said clutch outer member.

3. A starter as claimed in claim 2 further comprising a slide member for sliding when a predetermined torque is applied thereto, wherein said alignment member is integrated with said slide member.

4. A starter as claimed in claim 2, wherein said alignment member is integrated with said internal gear.

5. A starter as claimed in claim 1, wherein said alignment member comprises a bearing disposed in said gap for supporting the outer periphery of said clutch outer member.

* * * * *